US006209453B1

(12) United States Patent
Watanabe

(10) Patent No.: US 6,209,453 B1
(45) **Date of Patent: *Apr. 3, 2001**

(54) METHOD FOR PERFORATING HEAT-SENSITIVE STENCIL SHEET AND STENCIL SHEET AND COMPOSITION THEREFOR

(75) Inventor: Hideo Watanabe, Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/301,764

(22) Filed: Apr. 29, 1999

Related U.S. Application Data

(62) Division of application No. 08/799,941, filed on Feb. 13, 1997, now Pat. No. 5,924,359.

(30) Foreign Application Priority Data

Feb. 16, 1996 (JP) ..... 8-54103
Sep. 13, 1996 (JP) ..... 8-265600

(51) Int. Cl.[7] ..... B41C 1/14
(52) U.S. Cl. ..... 101/128.4; 101/128.21
(58) Field of Search ..... 101/127, 128.21, 101/128.4, 129

(56) References Cited

U.S. PATENT DOCUMENTS 4,585,815 4/1986 Ono et al. ..... 524/23
5,085,933 * 2/1992 Katoh et al. ..... 428/332
5,824,362 * 10/1998 Watanabe ..... 427/143

FOREIGN PATENT DOCUMENTS 0 609 076 A2 8/1994 (EP) .
0 635 362 A1 1/1995 (EP) .
0 661 356 A1 7/1995 (EP) .
0 767 053 4/1997 (EP) .
2 206 704 6/1974 (FR) .

* cited by examiner

*Primary Examiner*—Daniel J. Colilla
(74) *Attorney, Agent, or Firm*—Pillsbury Madison & Sutro LLP

(57) ABSTRACT

A heat-sensitive stencil sheet, and a method and a composition for perforating the same are provided, in which photothermal conversion materials transferred to the stencil sheet do not blur or spread but are fixed thereon faithfully to desired images, and clear images are printed. The heat-sensitive stencil sheet has on a side thereof a liquid absorbing layer to which the photothermal conversion material is to be transferred, and the liquid absorbing layer comprises a hydrophilic resin and a water-repellent compound, and optionally organic and/or inorganic particulates. The hydrophilic resin and the water-repellent compound may be mixed at a proportion sufficient to provide a contact angle of 20 to 150 degrees between the liquid absorbing layer and the liquid. The liquid, in which the photothermal conversion material is containd, can comprise water and/or a hydrophilic solvent. The liquid absorbing layer preferably has a softening or melting point of 40 to 120°C. and has a thickness of 0.01 to 20 μm.

7 Claims, 2 Drawing Sheets

METHOD FOR PERFORATING HEAT-SENSITIVE STENCIL SHEET AND STENCIL SHEET AND COMPOSITION THEREFOR

This is a division of application Ser. No 08/,799,941, filed Feb. 13, 1997 now U.S. Pat. No. 5,924,359.

BACKGROUND OF THE INVENTION

1. Field of the Invention

The present invention relates to a method for perforating a heat-sensitive stencil sheet, and more specifically relates to a method of perforating a heat-sensitive stencil sheet by exposing it to a visible or infrared ray to make a master for stencil or screen printing, and a heat-sensitive stencil sheet and a composition useful for the method.

2. Description of Related Art

As a structure of conventional heat-sensitive stencil sheets, is known a multilayer which is composed of a thermoplastic film laminated to an ink-permeable porous substrate made of Japanese paper or the like, or one layer which is composed simply of a thermoplastic film.

Methods for perforating such heat-sensitive stencil sheets to obtain masters for stencil or screen printing, include (1) a process of overlaying a heat-sensitive stencil sheet on images or letters that have been formed with carbon-containing materials such as pencils and toner by hand-writing or photocopying, and then exposing it to light from flash lamps, infrared lamps or the like to cause the portions of letters or images to emit heat so that the thermoplastic film of the stencil sheet is molten and perforated at portions that contact the images or letters, and (2) a process of melting and perforating the thermoplastic film of the stencil sheet by bringing the stencil sheet into contact with a thermal printing head which emits heat in dot-matrix forms so as to reproduce images in accordance with image data of electric signals that original images or letters have been transformed into.

In the above process (1), however, failure in perforation often occurs due to insufficient contact of the thermoplastic film of the stencil sheet with the original or the photocopied image portions of toner from which heat is emitted, or problems on so-called "pin holes" also occur which are phenomena of perforations caused in the stencil sheet at undesired portions by heat emitted from dust on the surface of the original or toner scattered out of the image portions. In the above process (2), there often occur perforation failure, conveying failure and wrinkling of the stencil sheet due to unevenness of pressure exerted to press the stencil sheet to the thermal printing head.

In order to solve such problems, the present inventor suggested, in Japanese Patent Application No. 284610/95, a method for perforating a heat-sensitive stencil sheet, which comprises ejecting a photothermal conversion material contained in a liquid from a liquid-ejecting means to transfer it together with said liquid to a heat-sensitive stencil sheet, and then exposing said heat-sensitive stencil sheet to a visible or infrared ray to perforate said heat-sensitive stencil sheet specifically at portions to which said photothermal conversion material has been transferred. This perforating method comprises a first step of transferring a photothermal conversion material to a heat-sensitive stencil sheet by ejecting a liquid, which contains the photothermal conversion material, to the heat-sensitive stencil sheet from a liquid-ejecting means which is out of contact with the stencil sheet, and the second step of perforating the heat-sensitive stencil sheet specifically at sites to which the photothermal conversion material has been transferred, by subjecting the stencil sheet to a visible or infrared ray.

The perforation method is advantageous in that little pin hole is formed in the stencil sheet since the stencil sheet does not have to be brought into contact with the original or the liquid ejecting means upon perforation, Similarly, since the stencil sheet is liberated from contact with the original or a thermal printing head that has been required in conventional perforating methods, any problem of perforation failure due to contact failure does not occur, and the stencil sheet is perforated faithfully to image information.

The present inventor also suggested, in the above Japanese Patent Application No. 284610/95, that a liquid absorbing layer is provided with a heat-sensitive stencil sheet on a surface to which the liquid is to be ejected, in order to prevent the liquid from spreading on the surface of the stencil sheet and promote the liquid to dry. In this perforating method, however, quality of perforations in stencil sheets is often greatly influenced by a condition of the liquid transferred to the liquid absorbing layer. In other words, if the liquid transferred to the liquid absorbing layer blots or spreads larger than the size of droplets of the liquid ejected from a liquid ejecting means, and then is exposed to a visible or infrared ray, perforations are also made larger in size, through which a large amount of ink are passed upon printing, yielding a blurred and unclear image on prints. Conversely, if the liquid does not have sufficient affinity with the liquid absorbing layer, the liquid is repelled by the liquid absorbing layer and causes so-called beading phenomena on the layer. In this case, the liquid is difficult to be fixed to the absorbing layer, and takes much time to dry. If a visible or infrared ray is radiated to the liquid absorbing layer in that state, much energy and time are required to perforate the stencil sheet, and perforations which form an image or letter are not uniformly made, yielding unclear and too light images on prints.

It is an object of the present invention to provide a method of perforating a heat-sensitive stencil sheet, which overcomes the above mentioned problems, and in which a liquid ejected from the liquid ejecting means and transferred onto the liquid absorbing layer is fixed faithfully thereto to provide a clear image. It is another object of the present invention to provide a heat-sensitive stencil sheet and a composition which are useful in the above method of perforating a heat-sensitive stencil sheet.

SUMMARY OF THE INVENTION

According to the present invention, a method of perforating a heat-sensitive stencil sheet particularly to make a master for screen or stencil printing is provided, which comprises ejecting a photothermal conversion material contained in a liquid from a liquid-ejecting means to transfer it together with the liquid to a heat-sensitive stencil sheet, and then exposing the heat-sensitive stencil sheet to a visible or infrared ray to perforate the heat-sensitive stencil sheet specifically at portions to which the photothermal conversion material has been transferred, said heat-sensitive stencil sheet having on a side thereof a liquid absorbing layer to which said photothermal conversion material is transferred, and said liquid absorbing layer comprising a hydrophilic resin and a water-repellent compound.

Since the present invention employs a heat-sensitive stencil sheet having on a side thereof a liquid absorbing layer which comprises a hydrophilic resin and a water-repellent compound, it is possible to prevent the liquid containing the photothermal conversion material from spreading on the liquid absorbing layer, promote the photothermal conversion material to be fixed to the liquid absorbing layer, and accelerate drying of the liquid.

DETAILED DESCRIPTION

The hydrophilic resin used for the liquid absorbing layer of the present invention includes resins soluble in water and/or alcohols, for example, polyvinyl alcohol, methyl cellulose, carboxymethyl cellulose, hydroxyethyl cellulose, polyvinyl pyrrolidone, ethylene-vinyl alcohol copolymers, polyethylene oxide, polyvinyl ether, polyvinyl acetal, polyvinyl butyral, polyacrylamide, and the like. These resins can be used alone, in combination or as a copolymer.

The water-repellent compound used for the liquid absorbing layer of the present invention includes fluorinated compounds, silane compounds, waxes, higher fatty acids, higher fatty acid amides and polyolefins, for example, tetrafluoroethylene resin, tetrafluoroethylene-hexafluoropropylene copolymer, tetrafluoroethylene-perfluoroalkyl vinyl ether copolymer, silicone resin, dimethylsilicone oil, methylphenylsilicone oil, cyclic dimethylsiloxane, modified silicone oil, carnauba wax, microcrystalline wax, polyethylene wax, montan wax, paraffin wax, candelilla wax, shellac wax, oxide wax, ester wax, bees wax, haze wax, spermaceti, stearic acid, lauric acid, behenic acid, caproic acid, palmitic acid, stearic acid amide, lauric acid amide, behenic acid amide, caproic acid amide, palmitic acid amide, polyethylene, polypropylene, and the like. These waterre-pellent compounds can be used as solid powders or liquid, and can be contained in the liquid absorbing layer in dissolved or dispersed state.

It is desired that the hydrophilic resin and the water-repellent compound are contained in the liquid absorbing layer of the present invention at a proportion sufficient to provide a contact angle of 20 to 150 degrees, preferably 30 to 130 degrees between the liquid absorbing layer and the liquid that has been transferred to the liquid absorbing layer together with photothermal conversion materials. If the contact angle is less than 20 degrees, the transferred liquid blurs or spreads on the liquid absorbing layer. If the contact angle is more than 150 degrees, the liquid is repelled by the liquid absorbing layer, causing the beading phenomena.

Concrete blending proportion of the hydrophilic resin to the water-repellent compound (i.e., the hydrophilic resin/the water-repellent compound) to attain the above contact angle varies depending upon kinds of the liquid containing photothermal conversion materials, and would be appropriately selected by the skilled in the art, usually within a range of 99/1 to 1/99, preferably 10/1 to 1/10.

In order to promote absorption and fixation of the liquid containing photothermal conversion materials in the liquid absorbing layer, organic or inorganic particulates may be added to the liquid absorbing layer. Such particulates include organic particulates such as of polyurethane, polyethylene terephthalate, polybutylene terephthalate, polyethylene, polystyrene, silicone resin such as polysiloxane, phenol resin, acrylic resin, and benzoguanamine resin, and inorganic particulates such as of talc, clay, calcium carbonate, titanium oxide, aluminum oxide, silicon oxide and kaolin.

The liquid absorbing layer of the present invention preferably has a softening or melting point of 40 to 120° C., more preferably 50 to 100° C. When it is less than 40° C., the liquid absorbing layer is influenced by the environmental temperature at which heat-sensitive stencil sheets are stored, and stencil sheets are often changed in mechanical or thermal properties, causing troubles upon perforation or printing. When it is more than 120° C., perforation of a stencil sheet requires a large amount of heat energy, takes much time, and requires a high-powered perforating apparatus.

The liquid absorbing layer of the present invention preferably has a thickness of 0.01 to 20 $\mu$m, more preferably 0.05 to 10 $\mu$m. When it is less than 0.01 $\mu$m, the liquid ejected with photothermal conversion materials is not sufficiently fixed. When it is more than 20 $\mu$m, perforation of the stencil sheet requires a large amount of heat energy, takes much time, and requires a high-powered perforating apparatus.

The liquid absorbing layer can be formed on a heat-sensitive stencil sheet, for example, by applying a mixed solution containing the above hydrophilic resin and the above water-repellent compound and if necessary the above organic or inorganic particulate, to a stencil sheet by use of a coating means such as a gravure coater and a wire bar coater, and then drying it.

The heat-sensitive stencil sheet may be a stencil sheet which can be molten and perforated by heat emitted by photothermal conversion materials. The stencil sheet may be made of a thermoplastic film only, or may be a thermoplastic film laminated to a porous substrate.

The thermoplastic film includes a film made from polyethylene, polypropylene, polyvinyl chloride, polyvinylidene chloride, polyethylene terephthalate, polybutylene terephthalate, polystyrene, polyurethane, polycarbonate, polyvinyl acetate, acrylic resin, silicone resin, or other resinous compounds. These resinous compounds may be used alone, in combination, or as a copolymer. Suitable thickness of the thermoplastic film is 0.5–50 $\mu$m, preferably 1–20 $\mu$m. If the film is less than 0.5 $\mu$m in thickness, it is inferior in workability and strength. If the film is greater in thickness than 50 $\mu$m, it is not economical to be perforated requiring a great amount of heat energy.

The above porous substrate may be a thin paper, a nonwoven fabric, a gauze or the like, which is made from natural fibers such as Manila hemp, pulp, Edgeworthia, paper mulberry and Japanese paper, synthetic fibers such as of polyester such as polyethylene terephthalate, nylon, vinylon and acetate, metallic fibers, or glass fibers, alone or in combination. Basis weight of these porous substrates is preferably 1–20 g/m$^2$, more preferably 5–15 g/m$^2$. If it is less than 1 g/m$^2$, stencil sheets are weak in strength. If it is more than 20 g/m$^2$, stencil sheets are often inferior in ink permeability upon printing. Thickness of the porous substrate is preferably 5–100 $\mu$m, more preferably 10–50 $\mu$m. If the thickness is lower than 5 $\mu$m, stencil sheets are weak in strength. If it is greater than 100 $\mu$m, stencil sheets are often inferior in ink permeability upon printing.

The photothermal conversion material used in the present invention is a material which can transform light energy into heat energy, and is preferably a material efficient in photothermal conversion, such as carbon black, lampblack, silicon carbide, carbon nitride, metal powders, metal oxides, inorganic pigments, organic pigments, and organic dyes. Among organic dyes, preferred are those having a high light-absorbency within a specific range of wavelength, such as anthraquinone colorings, phthalocyanine colorings, cyanine colorings, squalirium colorings, and polymethine colorings.

The liquid in which the photothermal conversion material is contained according to the present invention, may be water and/or hydrophilic solvents. In this case, when the liquid containing photothermal conversion materials is transferred to the liquid absorbing layer, the liquid first maintains a suitable contact angle with the liquid absorbing layer by virtue of the effect of the water-repellent compound, and then dissolves or swells the liquid absorbing layer by virtue of the effect of the hydrophilic resin. Thus, the liquid containing photothermal conversion materials does not blur or spread and is not repelled by the liquid absorbing layer, so that it is readily fixed thereon. As a result, desired images or letters can be reproduced on the heat-sensitive stencil sheet with photothermal conversion materials. Then, when a visible or infrared ray is radiated to the stencil sheet, perforations are formed in the stencil sheet in the form of desired images or letters.

The hydrophilic solvent includes alcoholic solvents such as methyl alcohol, ethyl alcohol, isopropyl alcohol and butyl alcohol, glycol solvents such as ethylene glycol, diethylene glycol, triethylene glycol, propylene glycol, ethylene glycol dibutyl ether, diethylene glycol dibutyl ether, thioglycol, thiodiglycol and glycerin as well as ketone, amine and ether solvents. Such ketone, amine and ether hydrophilic solvents include acetone, methyl ethyl ketone, tetrahydrofuran, 1,4-dioxane, 2-pyrrolidone, N-methyl-2-pyrrolidone, formaldehyde, acetaldehyde, methylamine, ethylenediamine, dimethylformamide, dimethyl sulfoxide, pyridine, ethylene oxide and the like. To the liquid, may be added pigments, fillers, binders, hardening agents, preservatives, wetting agents, surfactants, pH-adjusting agents or the like, as required.

Thus, a composition for perforating a heat-sensitive stencil sheet can be prepared by appropriately dispersing or mixing the above photothermal conversion material in or with the above liquid, in a form readily ejectable from the liquid-ejecting means.

The present method for perforating a stencil sheet to make a master for screen or stencil printing can be practiced by use of the stencil sheet having a surface thereof a liquid absorbing layer, by effecting a first step in which the above composition for perforating a heat-sensitive stencil sheet, which comprises a photothermal conversion material and a liquid, is transferred to the liquid absorbing layer of the stencil sheet by ejecting said composition from a liquid-ejecting means to the liquid absorbing layer, and a second step in which the heat-sensitive stencil sheet is perforated specifically at sites to which the photothermal conversion material has been transferred, by subjecting the stencil sheet to a visible or infrared ray.

The first step of the present method can be practiced, for example, by controlling a liquid-ejecting means to eject the liquid onto a heat-sensitive stencil sheet while the liquide-jecting means, which is maintained out of contact with the stencil sheet, is moved relative to the heat-sensitive stencil sheet in accordance with image data that have previously been transformed into electric signals, so that the image is reproduced on the heat-sensitive stencil sheet as adherends mainly composed of the photothermal conversion material.

The liquid-ejecting means may be a device which comprises nozzles, slits, a porous material, or a porous film providing 10–2000 openings per inch (i.e., 10 to 2000 dpi) and connected to piezoelectric elements, heating elements, liquid-conveying pumps or the like so as to eject the liquid together with the photothermal conversion material, intermittently or continuously, that is, in a form of dots or lines, in accordance with the electric signals for letters or images.

In the second step of the present method, when a visible or infrared ray is applied to the heat-sensitive stencil sheet to which a photothermal conversion material has been transferred, the photothermal conversion material absorbs light to emit heat. As a result, the thermoplastic film and the liquid absorbing layer of the heat-sensitive stencil sheet are molten and perforated to give a master for screen or stencil printing. In this way, the present perforating method does not require stencil sheets to contact any substance such as an original or thermal printing head to make a master, but only requires a stencil sheet itself to be exposed to a visible or infrared ray. Thus, no wrinkling occurs on stencil sheets upon making masters. The visible or infrared ray can readily be radiated using xenon lamps, flash lamps, halogen lamps, infrared heaters or the like.

A stencil sheet which has been perforated in accordance with the present invention can serve for printing with ordinary stencil printing apparatuses. For example, printed matter is obtained by placing printing ink on one side of the perforated stencil sheet, putting printing paper on the other side of the stencil sheet, and then passing the ink through the perforated portions of the stencil sheet by means of pressing, pressure-reducing or squeezing so as to transfer the ink onto the printing paper. Printing ink may be those conventionally used in stencil printing, such as oil ink, aqueous ink, water-in-oil (W/o) emulsion ink, oil-in-water (O/W) emulsion ink, and hot melt ink.

Hereinafter, the present invention will be explained in more detail by way of presently-preferred examples with reference to the accompanying drawings in which:

It should be construed that the following examples are presented for only illustrative purpose, and the present invention is not limited to the examples.

EXAMPLES

Example 1

A mixed liquid of 1 part by weight of polyvinyl alcohol, 1 part by weight of alcohol modified silicone oil, 70 parts by weight of water and 28 parts by weight of isopropyl alcohol was applied to a polyethylene terephthalate film of 2 $\mu$m in thickness with a wire bar coater, and dried to form a liquid absorbing layer of 0.5 $\mu$m in thickness. Then, a polyester cloth leaf of 200 mesh was laminated to the film on the side opposite to the liquid absorbing layer to obtain a heat-sensitive stencil sheet having a three layer structure of a liquid absorbing layer 1, a thermoplastic film 2 and a porous substrate 3, as shown in FIG. 1.

On the other hand, a liquid containing a photothermal conversion material was prepared by mixing 3 parts by weight of carbon black, 70 parts by weight of water, and 27 parts by weight of ethylene glycol.

Figure 1:
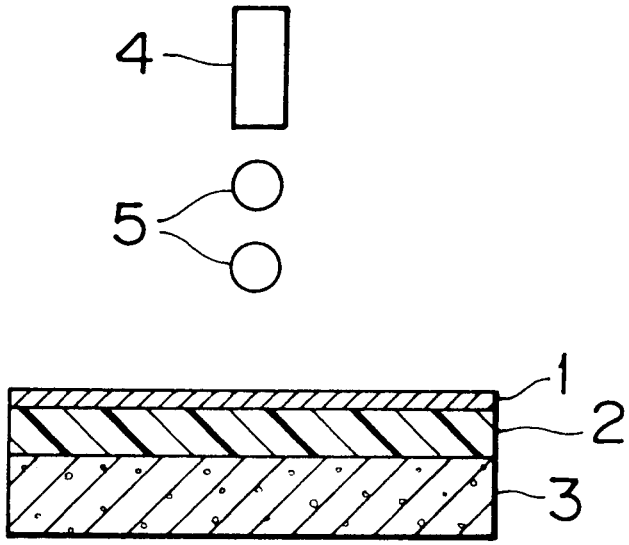
FIG. 1 is a sectional side view which diagrammatically shows a state in which a liquid containing a photothermal conversion material is ejected from a liquid ejecting means to a liquid absorbing layer of a heat-sensitive stencil sheet.
Figure 2:
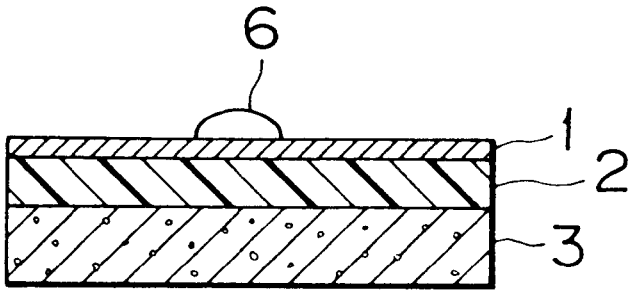
FIG. 2 is a sectional side view which diagrammatically shows a state in which a liquid containing a photothermal conversion material is transferred onto a heat-sensitive stencil sheet.

Then, as shown in FIG. 1, the liquid containing the photothermal conversion material was ejected as droplets 5 from a liquid ejecting means having 360 dpi nozzles to the liquid absorbing layer 1 of the heat-sensitive stencil sheet so that the droplets are transferred to the heat-sensitive stencil sheet as liquid 6 forming letter images as shown in FIG. 2. In this moment, the contact angle of the liquid 6 with the liquid absorbing layer 1 to which the liquid 6 has been transferred was 70 degrees.

Figure 3:
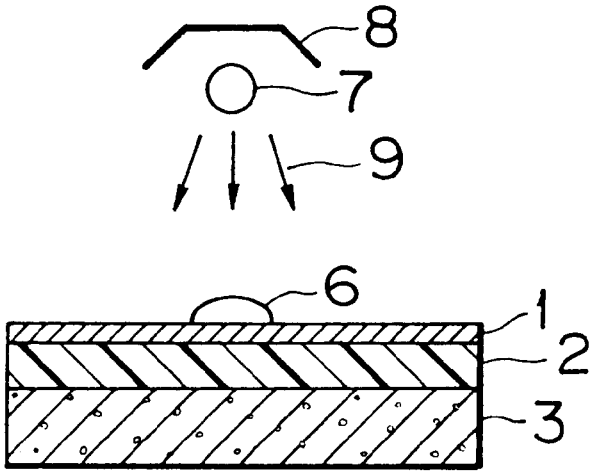
FIG. 3 is a sectional side view which diagrammatically shows a state in which light is radiated to a heat-sensitive stencil sheet onto which a liquid containing a photothermal conversion material has been transferred.
Figure 4:
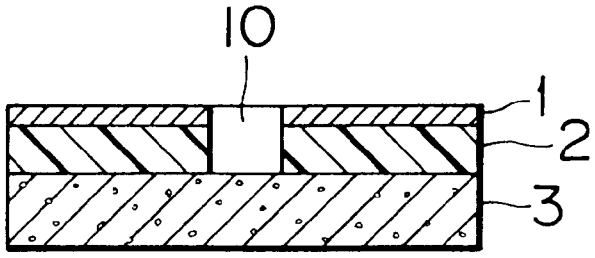
FIG. 4 is a sectional side view which diagrammatically shows a state in which a heat-sensitive stencil sheet is perforated after exposed to light.

Then, light 9 was radiated to letter image portions at which the liquid 6 containing the photothermal conversion material had been transferred and fixed, by use of a xenon flash 7 (SP275 manufactured by RISO KAGAKU CORPORATION) accompanied with a light reflector 8, as shown in FIG. 3. As a result, thanks to heat emitted by the photothermal conversion material at the letter image portions, the liquid absorbing layer 1 and the thermoplastic film 2 were molten to form perforations 10.

Then, stencil printing ink HIMESH INK (trade name) manufactured by RISO KAGAKU CORPORATION was placed on the polyester cloth leaf of the above perforated stencil sheet, and printing was effected with a portable stencil printing machine "PRINT GOCCO" (trade name) manufacture by RISO KAGAKU CORPORATION using the above stencil sheet. As a result, image which was sharp and faithful to the original was printed.

Example 2

A mixed liquid of 2 parts by weight of carboxymethyl cellulose, 1 part by weight of polyether modified silicone oil, 1 part by weight of silicon oxide particulates, 70 parts by weight of water and 26 parts by weight of isopropyl alcohol was applied to a polyvinylidene chloride film of 7 $\mu$m in thickness with a wire bar coater, and dried to form a liquid absorbing layer of 0.4 $\mu$m in thickness. Then, a polyester cloth leaf of 200 mesh was laminated to the film on the side opposite to the liquid absorbing layer to obtain a heat-sensitive stencil sheet.

Then, the liquid containing the photothermal conversion material was ejected to reproduce letter images by use of the same liquid ejecting means as in Example 1. In this moment, the contact angle of the liquid with the liquid absorbing layer to which the liquid has been transferred was 60 degrees.

Then, light was radiated using the xenon flash (SP275 manufactured by RISO KAGAKU CORPORATION) to perforate the stencil sheet, and stencil printing was effected using a portable stencil printing machine "PRINT GOCCO" (trade name) manufacture by RISO KAGAKU CORPORATION, in the same manner as in Example 1. As a result, image which was sharp and faithful to the original was printed.

Example 3

A mixed liquid of 1 part by weight of polyvinyl acetal, 1 part by weight of fluorinated resin powder, 50 parts by weight of water and 48 parts by weight of isopropyl alcohol was applied to a polyethylene terephthalate film of 2 $\mu$m in thickness with a wire bar coater, and dried to form a liquid absorbing layer of 0.7 $\mu$m in thickness. Then, a sheet of Japanese paper having a basis weight of 10 g/m$^2$ was laminated to the film on the side opposite to the liquid absorbing layer to obtain a heat-sensitive stencil sheet.

Then, the photothermal conversion material containing liquid, which consists of 5 parts by weight of a near-infrared absorbing phthalocyanine dye, 50 parts by weight of water, 30 parts by weight of diethylene glycol and 15 parts by weight of N-methyl-2-pyrrolidone, was ejected to the liquid absorbing layer of the above heat-sensitive stencil sheet to reproduce letter images thereon by use of a liquid ejecting means having 600 dpi nozzles. In this moment, the contact angle of the liquid with the liquid absorbing layer to which the liquid has been transferred was 80 degrees.

Then, light was radiated to letter image portions to which the photothermal conversion material containing liquid had been fixed, by use of a xenon flash (SP275 manufactured by RISO KAGAKU CORPORATION) in the same manner as in Example 1. As a result, thanks to heat emitted by the letter image portions, the stencil sheet was molten and perforated.

Then, stencil printing was effected using a digital stencil printing apparatus GR275 manufacture by RISO KAGAKU CORPORATION with the perforated stencil sheet being wound around the printing drum of the printing apparatus. As a result, image which was sharp and faithful to the original was printed.

According to the present invention, a liquid absorbing layer which contains a hydrophilic resin and a water-repellent compound is provided with a heat-sensitive stencil sheet, and a liquid containing a photothermal conversion material is ejected directly to the liquid absorbing layer. Thus, the liquid that has been transferred to the liquid absorbing layer does not blur or spread, and is not repelled on the liquid absorbing layer or does not cause so-called beading phenomena. As a result, the liquid transferred can be fixed to desired sites on the liquid absorbing layer, and can provide prints which are clear and faithful to original images.

What is claimed is:

1. A method of perforating a heat-sensitive stencil sheet, which comprises ejecting a photothermal conversion material contained in a liquid from a liquid-ejecting means to transfer it together with the liquid to a heat-sensitive stencil sheet, and then exposing the heat-sensitive stencil sheet to a visible or infrared ray to perforate the heat-sensitive stencil sheet specifically at portions to which the photothermal conversion material has been transferred, said heat-sensitive stencil sheet comprising a thermoplastic film having a liquid absorbing layer on a side to which said photothermal conversion material is transferred, and said liquid absorbing layer comprising a hydrophilic resin and a water-repellent compound.

2. A perforating method according to claim 1, in which said liquid absorbing layer contains said hydrophilic resin and said water-repellent compound at a proportion of 99:1 to 1:99 sufficient to provide a contact angle of 20 to 150 degrees between said liquid absorbing layer and said liquid that has been transferred to said layer.

3. A perforating method according to claim 2, in which said liquid comprises water and/or a hydrophilic solvent.

4. A perforating method according to claim 1, in which said liquid absorbing layer contains organic or inorganic particulates.

5. A perforating method according to claim 1, in which said liquid absorbing layer has a softening or melting point of 40 to 120° C.

6. A perforating method according to claim 1, in which said liquid absorbing layer has a thickness of 0.01 to 20 $\mu$m.

7. A perforating method according to claim 1, in which said heat-sensitive stencil sheet comprises a thermoplastic film which is laminated to a porous substrate.

* * * * *